US010415352B2

(12) United States Patent
Thomas et al.

(10) Patent No.: US 10,415,352 B2
(45) Date of Patent: Sep. 17, 2019

(54) IN-LINE MUD SCREEN MANIFOLD USEFUL IN DOWNHOLE APPLICATIONS

(71) Applicant: Resource Rental Tools, LLC, New Iberia, LA (US)

(72) Inventors: Grant E. Thomas, New Iberia, LA (US); William J. Thomas, III, New Iberia, LA (US); William C. Thomas, P.E., Lafayette, LA (US)

(73) Assignee: Resource Rental Tools, LLC, New Iberia, LA (US)

( * ) Notice: Subject to any disclaimer, the term of this patent is extended or adjusted under 35 U.S.C. 154(b) by 0 days.

(21) Appl. No.: 16/135,457

(22) Filed: Sep. 19, 2018

(65) Prior Publication Data

US 2019/0085663 A1 Mar. 21, 2019

Related U.S. Application Data

(60) Provisional application No. 62/560,652, filed on Sep. 19, 2017.

(51) Int. Cl.
*E21B 43/10* (2006.01)
*E21B 43/08* (2006.01)
*E21B 17/042* (2006.01)

(52) U.S. Cl.
CPC ..... *E21B 43/10* (2013.01); *E21B 17/042* (2013.01); *E21B 43/086* (2013.01)

(58) Field of Classification Search
CPC ..... E21B 21/00; E21B 21/01; E21B 21/06; E21B 21/063; E21B 2021/007; E21B 2021/008; E21B 43/082; E21B 43/34
See application file for complete search history.

(56) References Cited

U.S. PATENT DOCUMENTS 834,431 A * 10/1906 Williams ..... B01D 35/02 210/448
1,112,117 A * 9/1914 Carbis ..... F16K 15/03 137/527.4

(Continued)

FOREIGN PATENT DOCUMENTS

CA 2877020 A1 * 10/2015 ..... E21B 43/34

OTHER PUBLICATIONS

Prior art Youtube video posted Jul. 29, 2014 showing conventional mud screen operations. See particularly at about 1:00 mins to 1:20 mins—https://www.youtube.com/watch?v=KZxUiFFVEAQ&feature=youtu.be.

*Primary Examiner* — Jennifer H Gay
(74) *Attorney, Agent, or Firm* — Zeman-Mullen & Ford, LLP

(57) ABSTRACT

A mud screen manifold in which a saver sub chamber, a screen chamber and a mud inlet chamber are formed in a body. A hollow saver sub is provided, suitable for insertion into the saver sub chamber after connection to a screen cage. When a shaped flange on the saver sub is received into a correspondingly shaped recess formed in the saver sub chamber, a mud flow inlet is in fluid flow communication with a cutout in the saver sub via the mud inlet chamber, and the saver sub is in fluid flow communication with the screen chamber via fluid flow through the screen cage. Contact seals prevent fluid flow from leaking around the screen cage. The mud inlet chamber, the saver sub and the saver sub cutout preferably cooperate to form a smooth-walled passageway for fluid flow communication between the mud inlet chamber and the screen cage.

20 Claims, 11 Drawing Sheets

*FIG. 4A*

(56) References Cited

U.S. PATENT DOCUMENTS 2,855,048 A * 10/1958 Jones ..... E21B 33/03 166/91.1
3,302,722 A * 2/1967 Madeley, Sr. ..... E21B 43/10 166/157
4,090,573 A * 5/1978 Rankin ..... E21B 21/00 166/84.2
4,106,562 A * 8/1978 Barnes ..... B01D 35/02 166/205
4,495,073 A * 1/1985 Beimgraben ..... E21B 21/002 166/227
5,738,172 A * 4/1998 van Mook ..... E21B 33/0355 166/205
6,598,685 B1 * 7/2003 Mashburn ..... E21B 21/002 166/227
7,980,330 B1 * 7/2011 LeJeune ..... E21B 41/0021 166/227
8,002,028 B2 * 8/2011 Swietlik ..... E21B 17/02 166/380
8,047,278 B2 * 11/2011 Swietlik ..... E21B 19/08 166/138
8,127,867 B1 * 3/2012 Droke ..... E21B 21/065 166/267
8,573,306 B2 * 11/2013 Donald ..... E21B 33/03 166/344
8,746,340 B2 * 6/2014 Mashburn ..... E21B 31/00 166/301
9,657,554 B2 * 5/2017 Morton, Jr. ..... E21B 43/084
2004/0079551 A1 * 4/2004 Herst ..... E21B 21/065 175/57
2004/0238180 A1 * 12/2004 McGee ..... B01D 21/2483 166/373
2005/0109503 A1 * 5/2005 Kutryk ..... B01D 35/02 166/227
2006/0065443 A1 * 3/2006 Hall ..... E21B 21/002 175/314
2006/0065444 A1 * 3/2006 Hall ..... E21B 17/003 175/314
2006/0213667 A1 * 9/2006 Mashburn ..... E21B 21/002 166/380
2010/0236833 A1 * 9/2010 Hall ..... E21B 21/00 175/314
2014/0311343 A1 * 10/2014 Hendrix ..... E21B 43/34 95/241
2018/0135371 A1 * 5/2018 Cherewyk ..... E21B 21/002
2018/0313178 A1 * 11/2018 Biggerstaff ..... E21B 21/08

* cited by examiner

IN-LINE MUD SCREEN MANIFOLD USEFUL IN DOWNHOLE APPLICATIONS

RELATED APPLICATIONS

This application claims the benefit of and priority to commonly-invented and commonly-assigned U.S. Provisional Application Ser. No. 62/560,652, filed Sep. 19, 2017. The entire disclosure of 62/560,652 is incorporated herein by reference.

FIELD OF THE DISCLOSURE

This disclosure is directed generally to efficient solids control in subterranean drilling applications (for example), and more particularly to an in-line mud screen manifold that in such drilling applications, simplifies the handling and replacement of conventional drop-down drilling mud screens.

BACKGROUND

Mud screen filters are used generally to filter drilling fluid before it flows down the inside of a drill string. The purpose is to prevent trash, debris or excessive solids or drill bit cuttings from entering or re-entering the drill string, so as to reduce the chance of plugging or clogging downhole tools to a point where they will not operate properly. The two most common conventional locations for placement of a mud screen are: (1) inside of the box end connection of the top joint of pipe as drilling occurs; and (2) further down the drill-string as an in-line mud screen.

Mud screens are conventionally "dropped into" the drill string at a joint of drill pipe as a new length of pipe is added to the string on the rig floor. See FIGS. 1A through 1D, and video at https://youtu.be/KZxUiFFVEAQ (particularly at about 1:05-1:15 minutes). FIGS. 1A through 1D depict the prior art as herein described. FIGS. 1A and 1B are schematic depictions of conventional drop-in mud screen 120 being inserted between pipe joints 110 and 130. FIG. 1A schematically shows mud pumps 150 delivering fluid flow F of drilling fluid to rig 100. FIG. 1B is an enlargement of FIG. 1A. FIG. 1C is an enlargement in section of conventional drop-in mud screen 120 as typically inserted between pipe joints 110 and 130. FIG. 1D is a flow chart describing the typical process of inserting conventional drop-in mud screen 120 between pipe joints 110 and 130. FIG. 1B is an enlargement of FIG. 1A at the rig floor, and FIG. 1C is a section through the drill string with mud screen installed at a pipe joint.

FIG. 1D depicts a flow chart 200 describing the general process illustrated on FIGS. 1A through 1C and as shown on the above-cited prior art video. Generally, the process involves first separating pipe joint 110 from pipe joint 130 per FIGS. 1A through 1C, or as described on flow chart 200, separating a top drive from old joint no. 1 (block 201) in situations where screen 120 is located at the top of a drill string before connection to a top drive. Screen 120 is removed and, if necessary, replaced (block 202). A new pipe joint is appended to the top of the old joint no. 1, becoming new joint no. 1 below the top drive (see block 203 on FIG. 1D), or alternatively becoming a new pipe joint 103 per FIGS. 1A through 1C. Mud screen 120 is dropped into new joint no. 1 (block 204), or alternatively into new pipe joint 130 per FIGS. 1A through 1C). The top drive is then reconnected to new joint no. 1 (block 205 on FIG. 1D), or alternatively pipe joint 110 is reconnected to new pipe joint 130. In either case, screen 120 has moved up one connection between pipe joints towards the rig as an additional pipe joint has been added to the drill string.

FIG. 1E in U.S. Provisional Application Ser. No. 62/560,652, incorporated herein by reference, depicts various types and styles of conventional drop-in mud screens that might be used in the prior art methods described with reference to FIGS. 1A through 1D. Users may select from among a combination of different shaped openings and/or mesh screens for screening out desired solids or other items.

There are at least three disadvantages of conventional drop-in mud screens as used in the prior art as described above. First, the mud screens can cause significant damage to the drill pipe connections, requiring cost and time to repair. As shown on FIG. 1C, some lengths of drill pipe may require special end connections 135 deployed to receive the mud screen. Such special end connections add expense to the cost of drill pipe, and may further require their own additional repairs if damaged.

Second, if a well control situation occurs, the presence of a drop-in mud screen in the drill string may (for example) restrict mud flow, and thus may become a serious impediment to regaining control of the well.

Third, as depicted in the prior art video cited above, removal and re-insertion of a drop-in mud screen adds additional steps, and therefore time, to the process of inserting additional pipe joints in a drill string. Time is always of the essence in drilling operations. Also, additional steps may bring additional personnel safety concerns. Further, operators may forget to remove or re-insert drop-in mud screens during an extended drilling operation. In such cases, redundant additional drop-in screens may be left in the drill string, or drill strings may operate for periods with no screen in place. Either situation is not optimal for efficient solids control.

SUMMARY OF DISCLOSED TECHNOLOGY

These and other drawbacks in the prior art are addressed by an in-line mud screen manifold ("MSM") as described in this disclosure. The disclosed MSM completely eliminates the need for drop-in mud screens placed inside the drill string. Preferably, with reference to FIG. 2, MSM 300 is placed in drilling fluid flow F between mud pumps 150 (remote from rig 100) and the mud standpipe at rig 100 (delivering mud to the rig floor).

In order to facilitate conventional pumping hardware connections, MSM 300 advantageously provides API hammer unions that match conventional mud flow piping. MSM 300 is further designed and built with the API unions facing the correct flow direction.

Embodiments of the disclosed MSM are engineered to reduce turbulence in fluid flow through the MSM, thereby promoting laminar flow. Laminar flow optimizes fluid flow velocity and volume through the MSM, and reduces wear on internal parts. Laminar flow further tends to encourage solids in the fluid to flow into the screen provided in the MSM rather than allowing solids to build up in and around other internal MSM components.

Embodiments of the disclosed MSM are further engineered to provide effective contact seals on internal parts in order to minimize, if not eliminate, leakage of unscreened fluid around the screen provided in the MSM. The MSM of this disclosure is therefore highly efficient at solids removal. At the same time, the internal seals are provided with quick and easy maintenance of the MSM in mind. Once taken out of service, design features of the MSM internals allow the MSM screen to be removed and cleaned or replaced quickly and efficiently.

The disclosed MSM embodiments provide at least the following additional technical advantages:

The location of the disclosed MSM enables the MSM to filter out trash, debris and other undesirable solids from the mud flow before the mud ever reaches the rig floor at the standpipe.

The disclosed MSM reduces scope for human error as compared to conventional drop-in mud screens as described above with reference to FIGS. 1A through 1D.

The disclosed MSM improves control of the well. Advantageously, the design will maximize the mud flow rate capacities of the drill mud pumps, and allow the continuous drilling for longer intervals without having to cease operations to clean out the MSM.

Conventional drop-in mud screens have also been known to break apart during operation. The pieces from the broken screen will then flow down with the mud to the bottom hole assembly. The broken pieces will likely damage MWD or LWD instruments, drill bit hardware and other expensive items. In severe cases, the presence of broken mud screen pieces in the bottom hole assembly may cause shut down of drilling operations, or even well control issues. The disclosed MSM eliminates the drop-in mud screen and thus reduces the chance of any of the foregoing adverse events occurring.

In a first aspect, embodiments of an MSM according to this disclosure comprise: a body, the body having mud flow inlet, a mud flow outlet and a screen insertion port; the body further having a saver sub chamber, a seal chamber, a screen chamber and a mud inlet chamber all formed therein, the seal chamber further providing a seal chamber interior surface formed thereon; wherein the screen insertion port is in fluid flow communication with the saver sub chamber, the mud flow outlet is in fluid flow communication with the screen chamber, and the seal chamber is in fluid flow communication with the saver sub chamber and the screen chamber; a hollow saver sub, the saver sub further having first and second saver sub ends, the saver sub having a cutout therein between the first and second saver sub ends; a shaped flange provided on the first saver sub end, the shaped flange disposed to be received into a correspondingly shaped recess formed in the saver sub chamber; an exterior of the second saver sub end having a first seal portion formed therein; wherein, when an elongate screen cage is rigidly connected to the second saver sub end, and when the saver sub and the screen cage are inserted through the screen insertion port and into the saver sub chamber such that the shaped flange is received into the shaped recess: (1) the mud flow inlet is in fluid flow communication with the saver sub cutout via the mud inlet chamber; (2) the saver sub is in fluid flow communication with the screen chamber via fluid flow through the screen cage; and (3) the saver sub first seal portion forms a first contact seal with the seal chamber interior surface.

In other embodiments according to the first aspect, the exterior of the second saver sub end has first and second seal portions formed therein with the first seal portion nearer the first saver sub end than the second seal portion; the exterior of the second saver sub end further provides an exterior threaded portion between the first and second seal portions; and the screen cage has an interior cage surface such that the interior cage surface forms a second contact seal with the saver sub second seal portion when the screen cage is rigidly connected to the second saver sub end via threaded engagement with the exterior threaded portion.

In other embodiments according to the first aspect, selected ones of the first and second contact seals are assisted by at least one o-ring.

In other embodiments according to the first aspect, the MSM further comprises a magnetic rod, the magnetic rod disposed to be rigidly connected to the saver sub while positioned within the saver sub. In some such embodiments, the first saver sub end provides saver sub interior threads; and the magnetic rod is disposed to be rigidly connected to the saver sub via threaded engagement with the saver sub interior threads.

In other embodiments according to the first aspect, the shaped flange and the shaped recess cooperate to locate the saver sub cutout in a predetermined unitary location and a predetermined unitary orientation relative to the mud inlet chamber each time the shaped flange is received into the shaped recess.

In other embodiments according to the first aspect, the mud inlet chamber and the saver sub chamber are straight throughbores subtending a predetermined mud flow angle. In some such embodiments, the predetermined mud flow angle is 45 degrees.

In other embodiments according to the first aspect, the mud inlet chamber, the saver sub and the saver sub cutout cooperate to form a smooth-walled passageway for fluid flow communication between at least the mud inlet chamber and the screen cage.

In other embodiments according to the first aspect, a downstream end of the saver sub cutout provides convex rim curvature.

In other embodiments according to the first aspect, the screen cage includes screen mesh for retaining solids during fluid flow through the screen cage. Alternatively, the screen cage may act as a retainer for a separate drop-in mud screen.

In a second aspect, embodiments of an MSM according to this disclosure comprise: a body, the body having mud flow inlet, a mud flow outlet and a screen insertion port; the body further having a saver sub chamber, a seal chamber, a screen chamber and a mud inlet chamber all formed therein, the seal chamber further providing a seal chamber interior surface formed thereon; wherein the screen insertion port is in fluid flow communication with the saver sub chamber, the mud flow outlet is in fluid flow communication with the screen chamber, and the seal chamber is in fluid flow communication with the saver sub chamber and the screen chamber; a hollow saver sub, the saver sub further having first and second saver sub ends, the saver sub having a cutout therein between the first and second saver sub ends; a shaped flange provided on the first saver sub end, the shaped flange disposed to be received into a correspondingly shaped recess formed in the saver sub chamber; an exterior of the second saver sub end having first and second seal portions formed therein with the first seal portion nearer the first saver sub end than the second seal portion; an elongate screen cage, the screen cage having an interior cage surface such that the interior cage surface forms a first contact seal with the saver sub second seal portion when the screen cage is rigidly connected to the second saver sub end; wherein, when the screen cage is rigidly connected to the second saver sub end, and when the saver sub and the screen cage are inserted through the screen insertion port and into the saver sub chamber such that the shaped flange is received into the shaped recess: (1) the mud flow inlet is in fluid flow communication with the saver sub cutout via the mud inlet chamber; (2) the saver sub is in fluid flow communication with the screen chamber via fluid flow through the screen cage; and (3) the saver sub first seal portion forms a second contact seal with the seal chamber interior surface.

In a third aspect, embodiments of an MSM according to this disclosure comprise: a body, the body having mud flow inlet, a mud flow outlet and a screen insertion port; the body further providing a saver sub chamber, a screen chamber and a mud inlet chamber all formed therein and all in fluid flow communication with each other; wherein the screen insertion port is in fluid flow communication with the saver sub chamber, and the mud flow outlet is in fluid flow communication with the screen chamber; a hollow saver sub, the saver sub further having first and second saver sub ends, the saver sub having a cutout therein between the first and second saver sub ends; wherein, when an elongate screen cage is rigidly connected to the second saver sub end, and when the saver sub and the screen cage are inserted through the screen insertion port and into the saver sub chamber such that the first saver sub end is towards the screen insertion port: (1) the mud flow inlet is in fluid flow communication with the saver sub cutout via the mud inlet chamber; (2) the saver sub is in fluid flow communication with the screen chamber via fluid flow through the screen cage; and (3) the mud inlet chamber, the saver sub and the saver sub cutout cooperate to form a smooth-walled passageway for fluid flow communication between at least the mud inlet chamber and the screen cage.

In other embodiments according to the third aspect, a shaped flange is provided on the first saver sub end, the shaped flange disposed to be received into a correspondingly shaped recess formed in the saver sub chamber; wherein the shaped flange and the shaped recess cooperate to locate the saver sub cutout in a predetermined unitary location and a predetermined unitary orientation relative to the mud inlet chamber each time the saver sub is inserted through the screen insertion port such that the shaped flange is received into the shaped recess.

In other embodiments according to the third aspect, the mud inlet chamber and the saver sub chamber are straight throughbores subtending a predetermined mud flow angle.

The foregoing has rather broadly outlined some features and technical advantages of the disclosed MSM, in order that the following detailed description may be better understood. Additional features and advantages of the disclosed technology may be described. It should be appreciated by those skilled in the art that the conception and the specific embodiments disclosed may be readily utilized as a basis for modifying or designing other structures for carrying out the same inventive purposes of the disclosed technology, and that these equivalent constructions do not depart from the spirit and scope of the technology as described.

BRIEF DESCRIPTION OF THE DRAWINGS

For a more complete understanding of the embodiments described in this disclosure, and their advantages, reference is made to the following detailed description taken in conjunction with the accompanying drawings, in which:

FIGS. 1A through 1D depict use of conventional drop-in mud screen technology, in which FIGS. 1A and 1B are schematic depictions of conventional drop-in mud screen 120 being inserted between pipe joints 110 and 130, FIG. 1C is an enlargement of conventional drop-in mud screen 120 as typically inserted between pipe joints 110 and 130, and FIG. 1D is a flow chart describing the typical process of inserting conventional drop-in mud screen 120 between pipe joints at a connection with a top drive;

FIGS. 4 and 4A are section views of a currently preferred embodiment of fully-assembled MSM 300, in which FIG. 4A is an enlargement as shown FIG. 4;

DETAILED DESCRIPTION

Figure 1B:
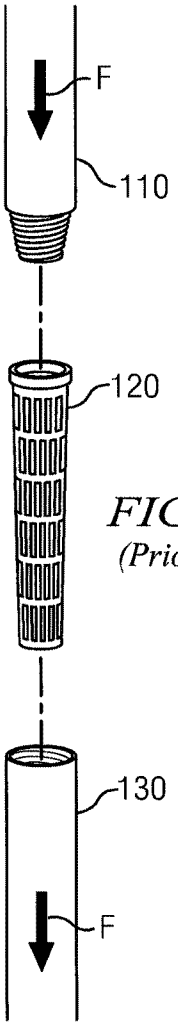
FIG. 1B (Prior Art)
Figure 1A:
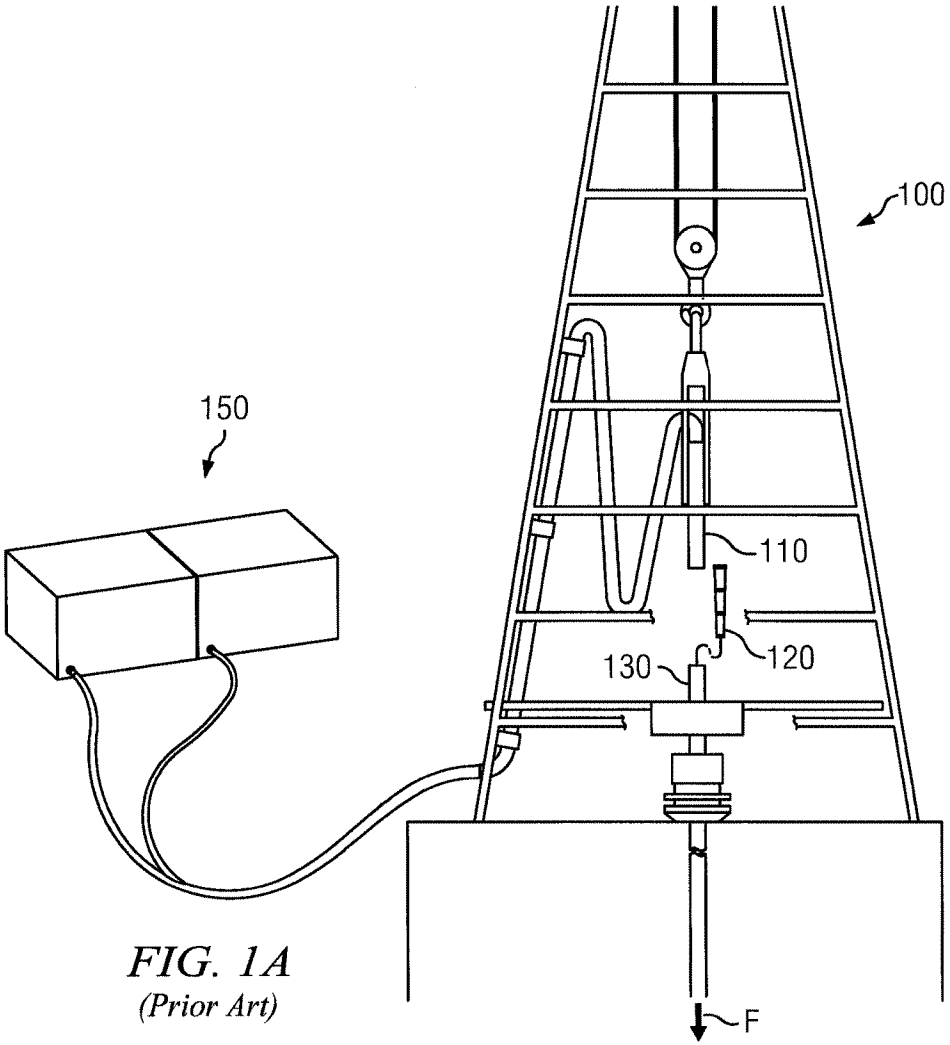
FIG. 1A (Prior Art)
Figure 1C:
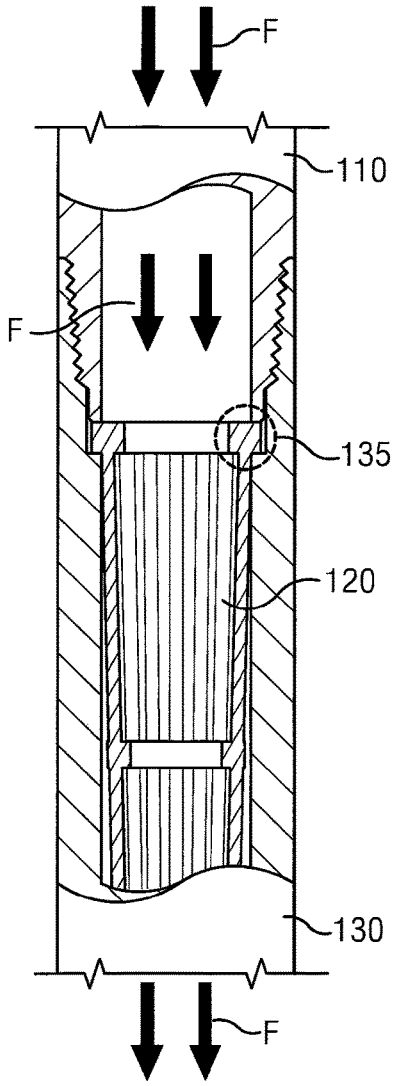
FIG. 1C (Prior Art)
Figure 1D:
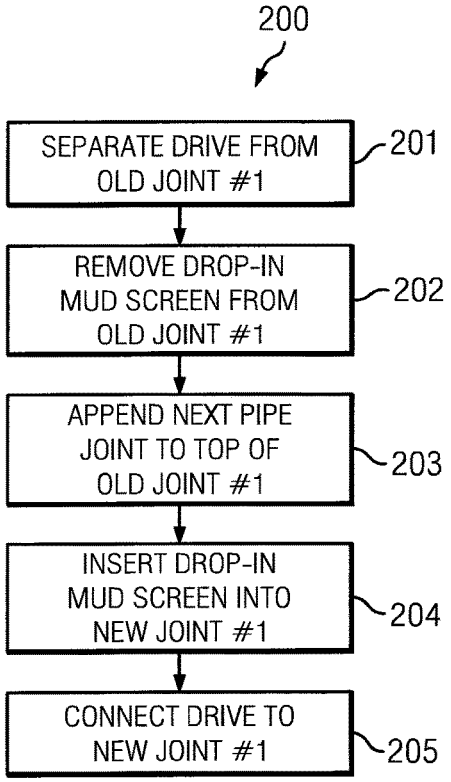
FIG. 1D (Prior Art)

FIGS. 2 through 6D and FIGS. 8A through 9 should be viewed together. Assemblies, items, parts or features identified on any one of FIGS. 2 through 6D and FIGS. 8A through 9 have the same reference numeral, letter or label where depicted elsewhere on such Figures.

Figure 3:
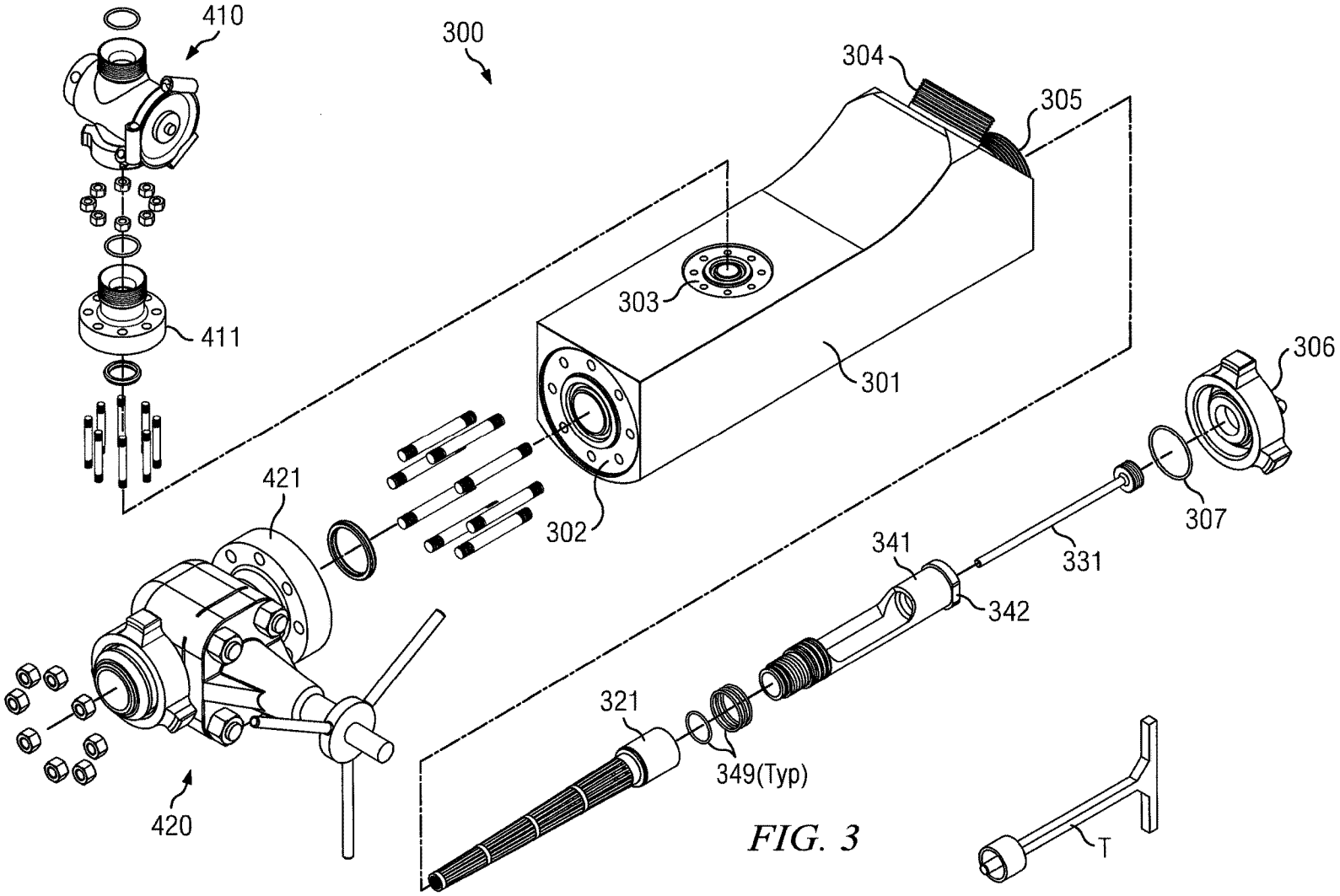
FIG. 3 is an exploded view of a currently preferred embodiment of MSM 300.
Figure 4:
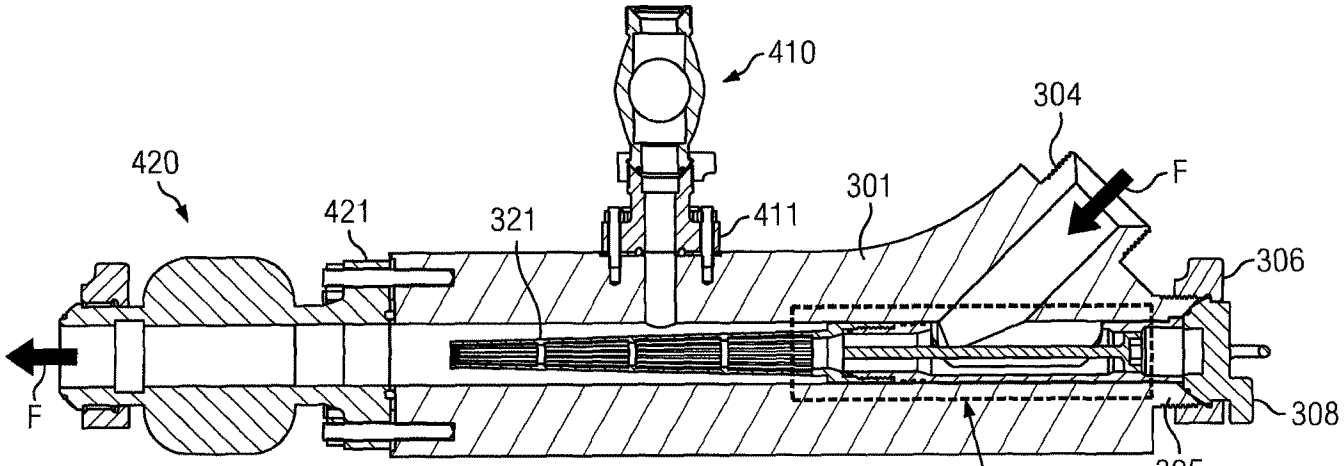
Figure 4A:
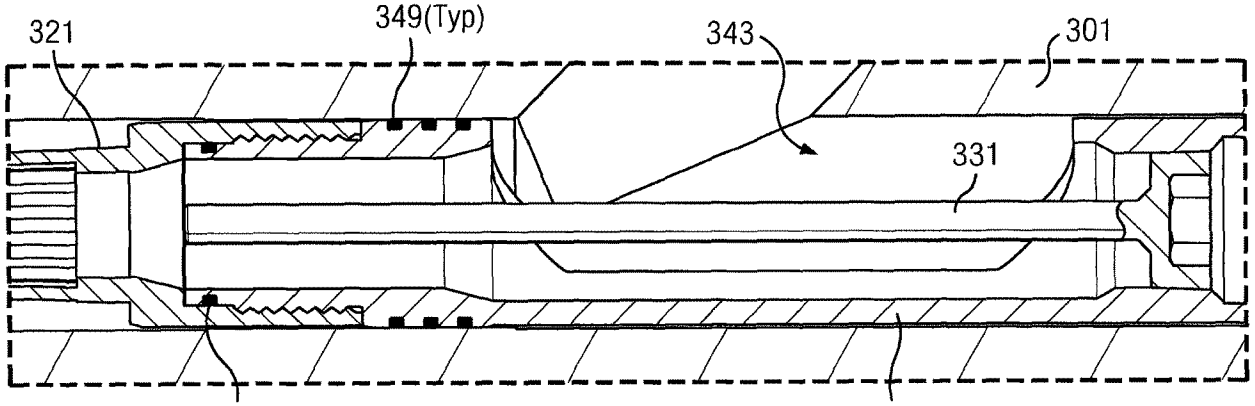

FIG. 3 is an exploded view of a currently preferred embodiment of MSM 300. FIG. 4 is a section view of a fully-assembled MSM 300, shown exploded in FIG. 3. FIG. 4A is an enlargement as shown on FIG. 4. It will be seen on FIGS. 3, 4 and 4A that MSM 300 generally comprises MSM body 301, in which screen cage 321, magnetic rod 331 and hollow saver sub 341 are slideably inserted and extracted through screen insertion port 305. Magnetic rod 331 is disposed to be rigidly connected to saver sub 341 while positioned within saver sub 341. In service, fluid flow F enters body 301 via mud flow inlet 304. Fluid flow F then passes into saver sub 341 via saver sub cutout 343, past magnetic rod 331 and on into screen cage 321. Having passed through screen cage 321, fluid flow F then exits MSM body 301 through mud flow outlet 302.

FIGS. 3, 4 and 4A further illustrate mud flow control valve assembly 420 including a conventional gate valve and a mud flow control valve flange 421 for connecting to mud flow outlet 302 on body 301. Mud flow control valve assembly 420 may be used to control fluid flow F through MSM 300, including to terminate flow to the rig when desired.

FIGS. 3, 4 and 4A further illustrate pressure relief valve assembly 410 including a conventional gate valve and a pressure relief valve flange 411 for connecting to pressure relief outlet 303 on body 301. Pressure relief valve assembly 410 may be used to bleed off fluid pressure in body 301 once MSM 300 is isolated from continuous fluid flow. Pressure bleed off is normally required prior to opening MSM 300 at screen insertion port 305, for example, in order to conduct maintenance or replacement of internals.

Figure 5B:
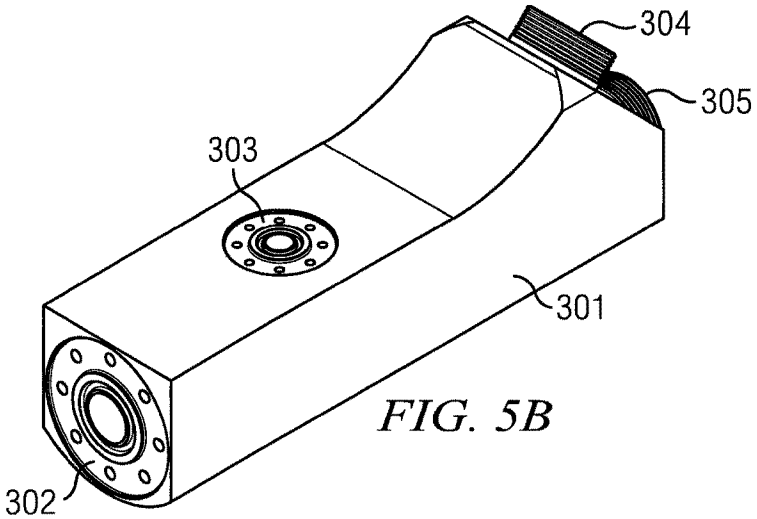
FIGS. 5A through 5C illustrate various views and features of a currently preferred embodiment of MSM body 301.
Figure 5A:
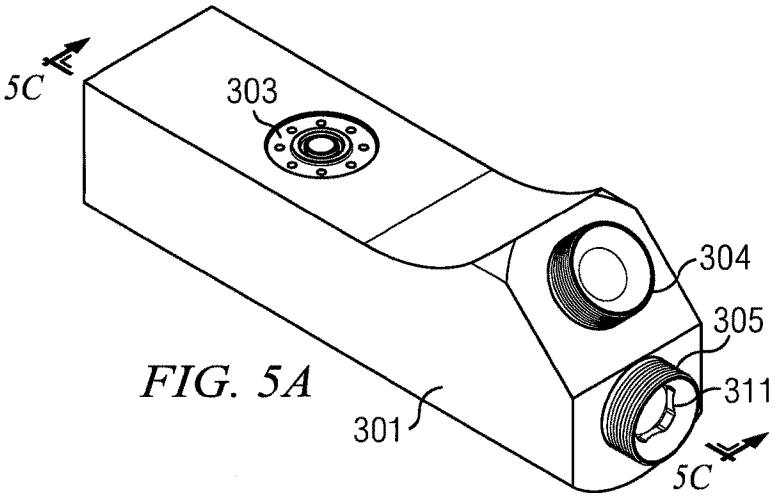
Figure 5C:
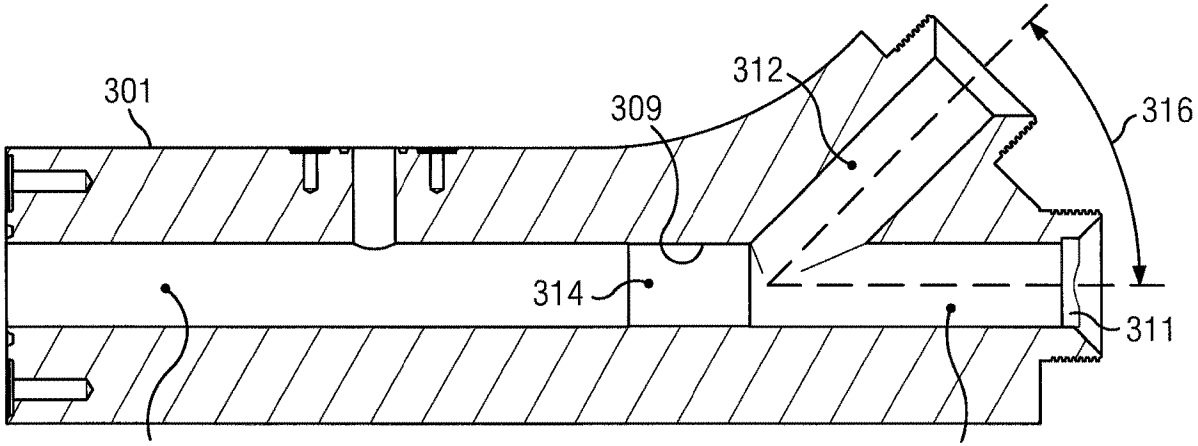
Figure 8B:
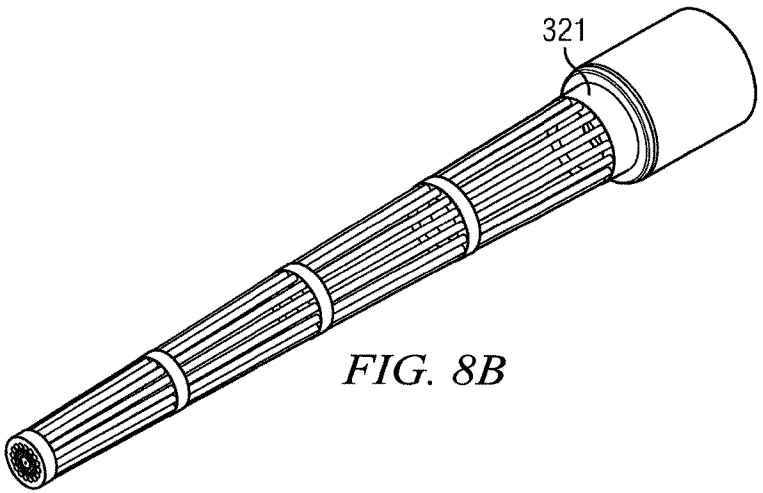
FIGS. 8A through 8C illustrate various views and features of a currently preferred embodiment of MSM screen cage 321.
Figure 8A:
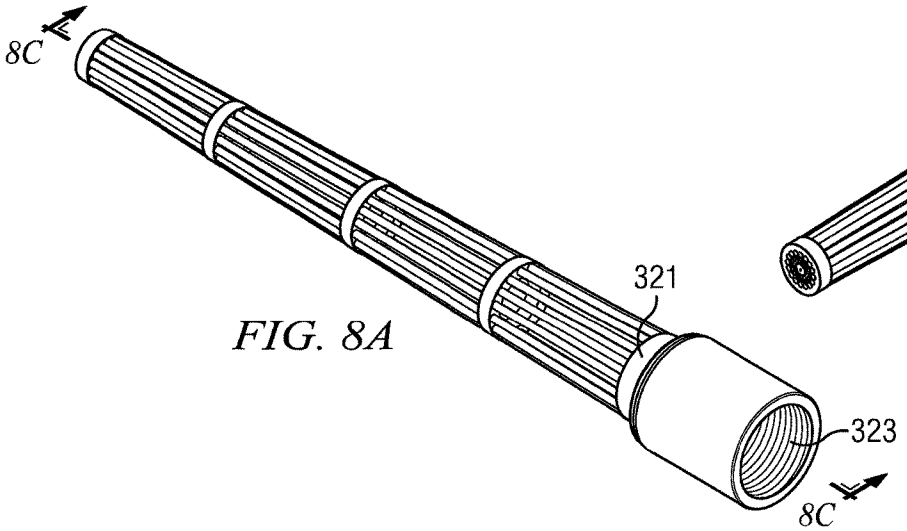
Figure 8C:
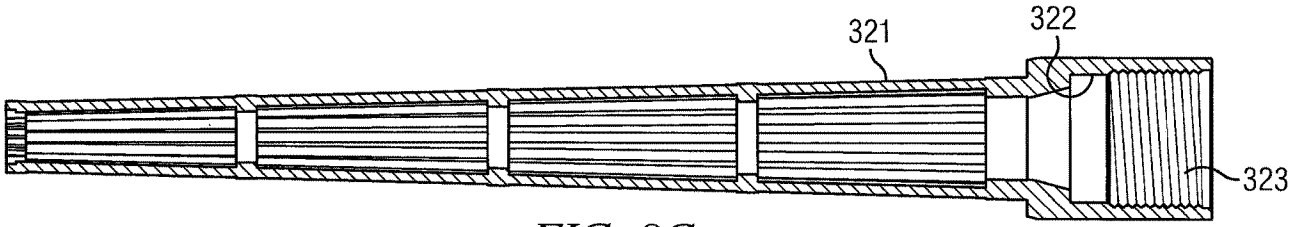

For general reference, FIGS. 5A, 5B and 5C illustrate views and features of a currently preferred embodiment of body 301 in isolation, FIGS. 6A, 6B, 6C and 6D illustrate views and features of a currently preferred embodiment of saver sub 341 in isolation, and FIGS. 8A, 8B and 8C illustrate views and features of a currently preferred embodiment of elongate screen cage 321 in isolation. Referring to FIGS. 5A, 5B and 5C, body 301 provides shaped recess 311 near screen insertion port 305. As will be described further on, shaped recess 311 is shaped and positioned to receive shaped flange 342 on saver sub 341 when saver sub is fully inserted into body 301 through screen insertion port 305. FIG. 5C further shows the interior of body 301 having mud inlet chamber 312, saver sub chamber 313, seal chamber 314 and screen chamber 315 formed therein. Interior surface 309 is formed on seal chamber 314, and will also be described in more detail below. FIGS. 5A, 5B and 5C illustrate screen insertion port 305 in fluid flow communication with saver sub chamber 313, mud flow outlet 302 in fluid flow communication with screen chamber 315, and seal chamber 314 in fluid flow communication with saver sub chamber 313 and screen chamber 315.

Figure 6B:
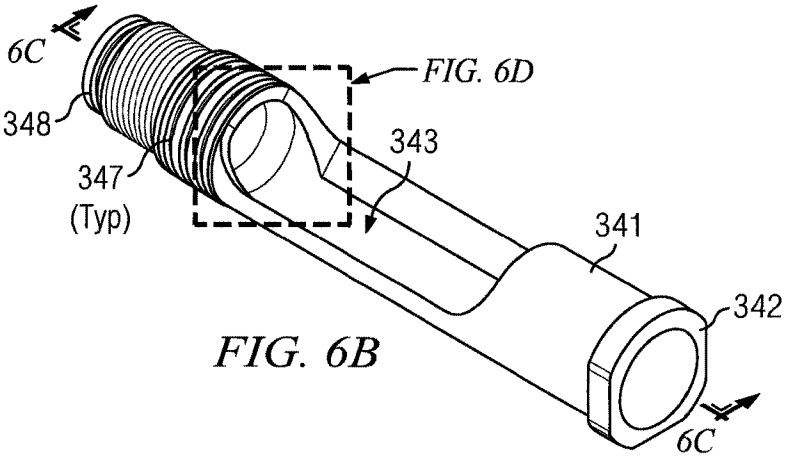
FIGS. 6A through 6D illustrate various views and features of a currently preferred saver sub embodiment 341.
Figure 6D:
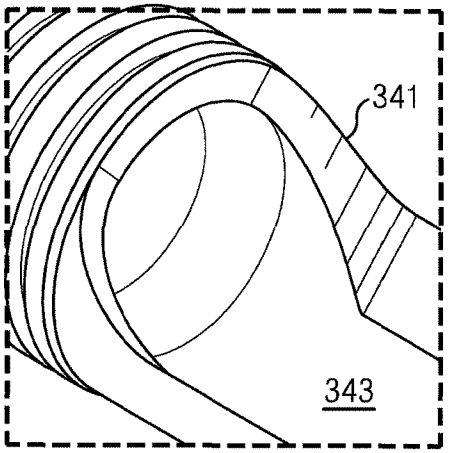
Figure 6A:
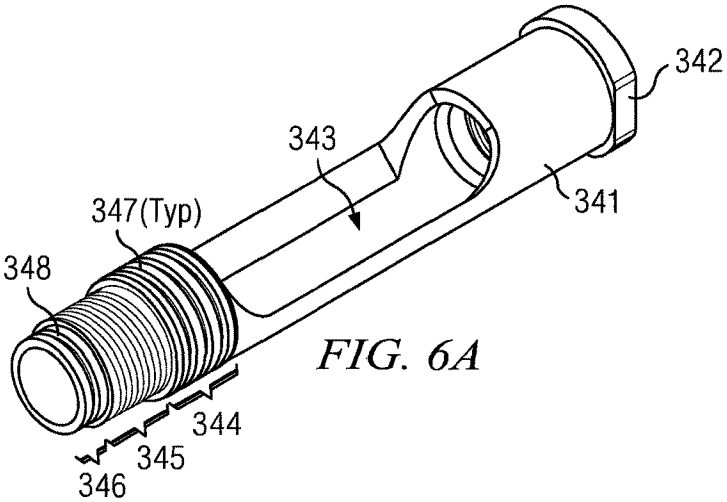

FIGS. 6 through 6D show saver sub 341 providing shaped flange 342 on a first end thereof, and saver sub cutout 343 between first and second ends of saver sub 341. Saver sub 341 further provides first seal portion 344, threaded portion 345, second seal portion 346, o-ring grooves 347 on first seal portion 344, and o-ring groove 348 on second seal portion 346. FIG. 6C further illustrates saver sub interior threads 361 between cutout 343 and shaped flange 342. FIG. 6D is an enlargement as shown on FIG. 6B. FIGS. 6A though 6D further illustrate that first seal portion 344, threaded portion 345 and second seal portion 346 are provided on the exterior of the second end of saver sub 341. First seal portion 344 is nearer the first end of saver sub 341 than second seal portion 346, and threaded portion 345 is positioned between first and second seal portions 344, 346.

FIGS. 8A, 8B and 8C show elongate screen cage 321 providing interior surface 322 and screen cage threads 323.

FIGS. 3 through 6D, and 8A through 8C collectively illustrate that when screen cage 321 is rigidly connected to the second saver sub end, and when saver sub 341 and screen cage 321 are inserted through screen insertion port 305 and into saver sub chamber 313 such that shaped flange 342 is received into shaped recess 311 formed in saver sub chamber 313: (1) mud flow inlet 304 is in fluid flow communication with saver sub cutout 343 via mud inlet chamber 312; and (2) saver sub 341 is in fluid flow communication with screen chamber 315 via fluid flow through screen cage 321. Further, shaped flange 342 and shaped recess 311 cooperate to locate saver sub cutout 343 in a predetermined unitary location and a predetermined unitary orientation relative to mud inlet chamber 312 each time saver sub 341 is inserted through screen insertion port 305 such that shaped flange 342 is received into shaped recess 311. Further, mud inlet chamber 312, saver sub 341 and saver sub cutout 343 cooperate to form a smooth-walled passageway for fluid flow communication between at least mud inlet chamber 312 and screen cage 321.

FIG. 3 illustrates exemplary tool T for inserting and extracting screen cage 321, saver sub 341 and magnetic rod 331 into and out of insertion port 305 on body 301. It will be appreciated that there are several suitable procedures by which such insertion and extraction may be done, and the scope of this disclosure is not limited to any particular procedure. In illustrated embodiments, screen cage 321 may first be attached to saver sub 341 by threaded engagement of screen cage threads 323 onto saver sub threaded portion 345. Suitable threads on tool T may then be engaged on saver sub interior threads 361. Tool T may then be used to insert screen cage 321 and saver sub 341 into body 301 through insertion port 305. Once saver sub first seal portion 344 is fully engaged with interior surface 309 on seal chamber 314, and shaped flange 342 is fully received into shaped recess 311, tool T may be unthreaded and removed from interior threads 361, leaving screen cage 321 and saver sub 341 in position inside body 301 ready for operational service. Magnetic rod 331, if desired, may now be inserted into saver sub 341 and threaded onto interior threads 361 using the hexagonal recess provided in a head portion of magnetic rod 331. Tool T may be adapted to provide a suitable hexagonal key to screw magnetic rod 331 in. As illustrated on FIGS. 3 and 4, end flange 306, end gasket 307 and end plug 308 may now be used to close off and seal insertion port 305 on body 301.

Extraction is essentially the reverse. If installed, magnetic rod 331 may be extracted once screen insertion port 305 is opened via removal of end flange 306, end gasket 307 and end plug 308. Tool T may be adapted to provide a suitable hexagonal key to engage the hexagonal recess provided in a head portion of magnetic rod 331, and then unscrew same. With magnetic rod 331 removed, tool T may threadably engage saver sub interior threads 361 and extract screen cage 321 and saver sub 341. Screen cage 321 may then be unscrewed from saver sub 341.

An open design is thus provided in illustrated embodiments in order to enable an internal pressure wash, if desired, before complete disassembly. The pressure wash removes an initial quantity of solids and debris from the assembled screen cage 321 and saver sub 341 while they are still resident in body 301. The initial removal of solids and debris also facilitates extraction of the assembled screen cage 321 and saver sub 341. If desired, the pressure wash may be done after removal of end flange 306, end gasket 307 and end plug 308, or alternatively after removal of magnetic rod 331 (if present).

In other embodiments (not illustrated), further internal threads may be provided on saver sub 341 immediately adjacent to and inside shaped flange 342. Tool T may be adapted to engage these further internal threads during insertion and extraction, rather than engaging interior threads 361 (shown on FIG. 6C). In such embodiments, magnetic rod 331 may be installed in saver sub 341 prior to insertion of screen cage 321 and saver sub 341 into screen insertion port 305, and the entire interconnected assembly of screen cage 321, magnetic rod 331 and saver sub 341 may be extracted together without removing magnetic rod 331 first.

In other embodiments (not illustrated), shaped flange 342 may be provided on saver sub 341 as a solid blank flange sealing off the end of saver sub 341. In such embodiments, a threaded hole may be provided blank shaped flange 342, in the surface thereof facing screen insertion port 305. Preferably, the threaded hole would not penetrate blank shaped flange 342. Tool T may be adapted to provide a corresponding threaded rod for engagement of the threaded hole. Once engaged in the threaded hole, tool T may then be used to perform insertions or retractions through insertion port 305. Alternatively, in embodiments in which the threaded hole penetrates blank shaped flange 342, a threaded plug may be used to close off the threaded hole prior to closing up insertion port 305.

Figure 9:
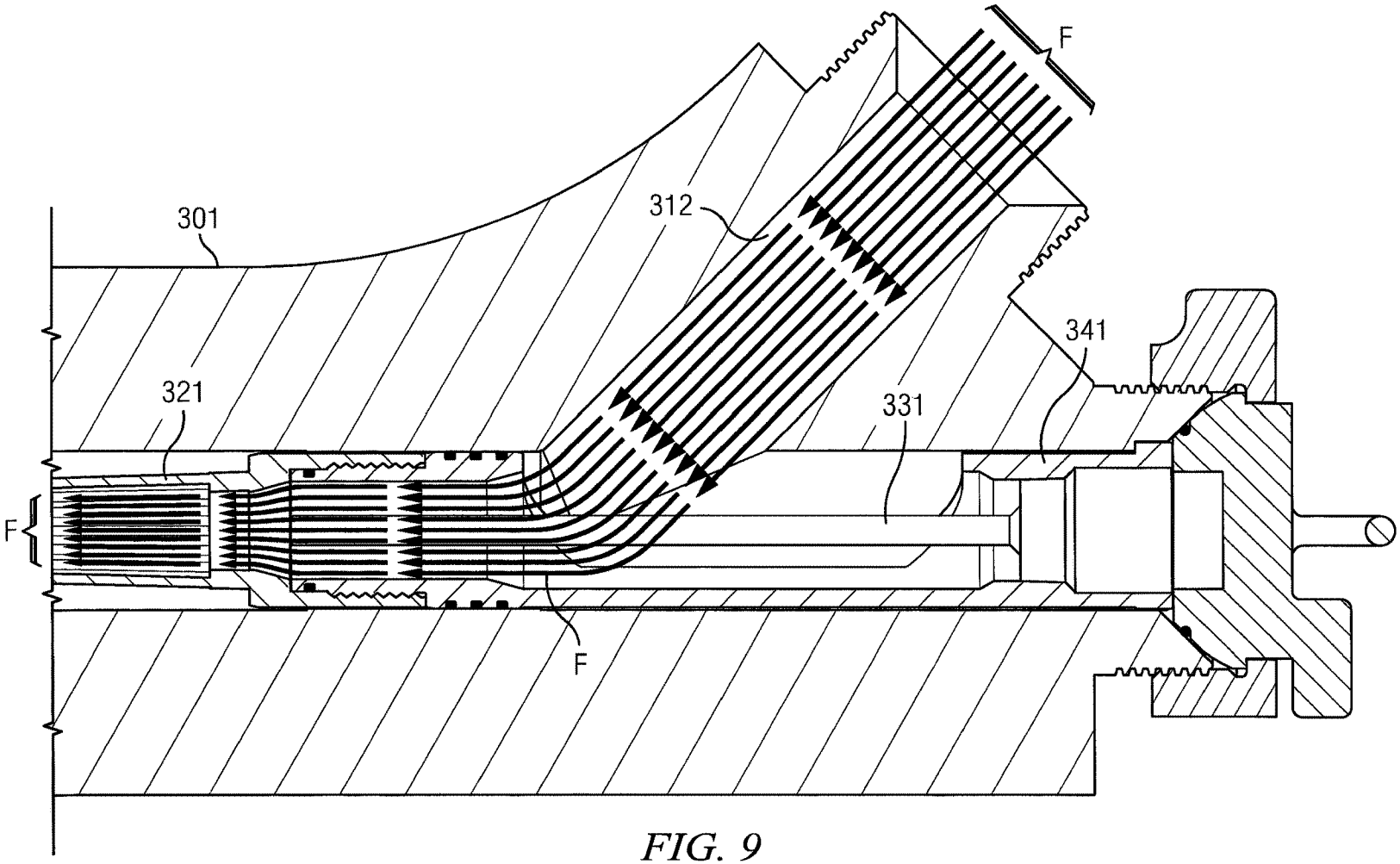
FIG. 9 illustrates fluid flow F in laminar flow through the MSM assembly according to FIGS. 4 and 4A.
Figure 10A:
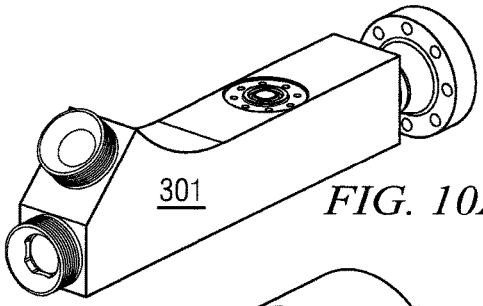
FIGS. 10A through 10J illustrate currently preferred MSM body embodiment 301 in comparison with alternative MSM body embodiments 301B through 301J.
Figure 10F:
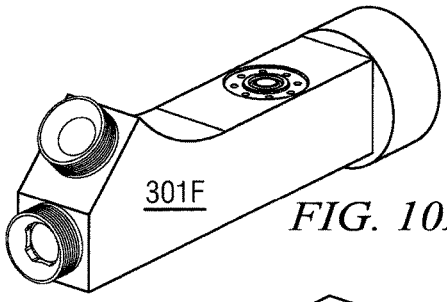
Figure 10B:
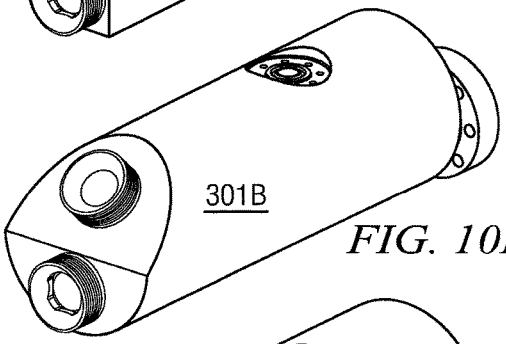
Figure 10G:
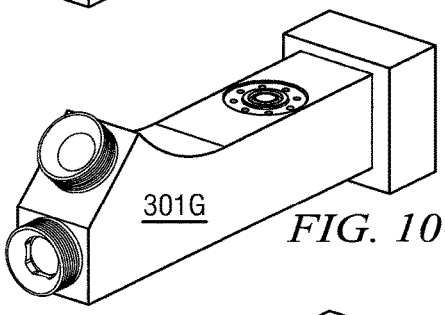
Figure 10C:
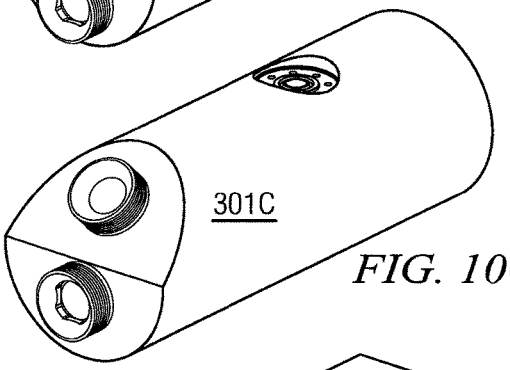
Figure 10H:
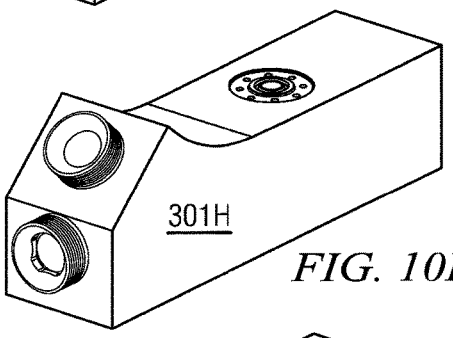
Figure 10D:
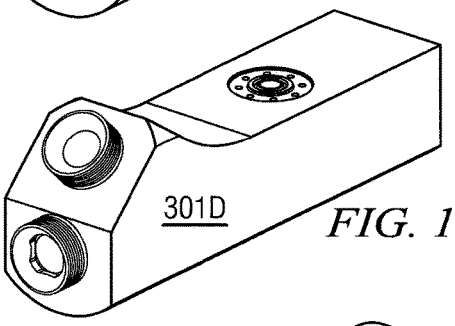
Figure 10I:
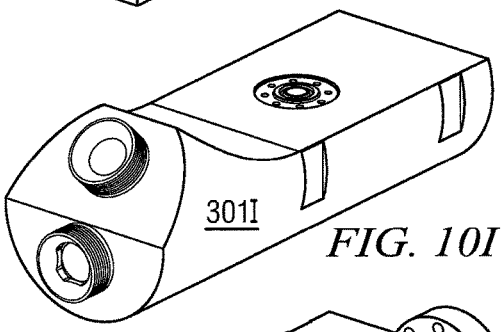
Figure 10E:
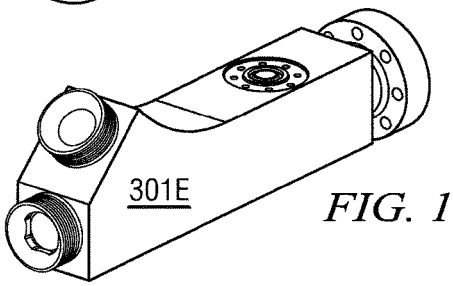
Figure 10J:
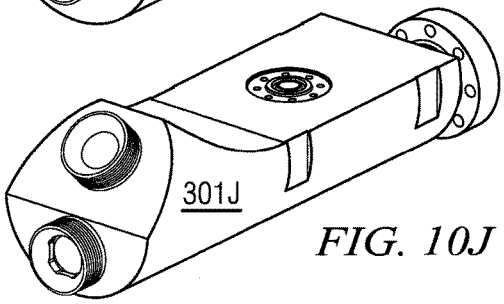

FIGS. 3 and 6B illustrate shaped flange 342 on saver sub 341. FIGS. 5A and 5C illustrate shaped recess 311 near screen insertion port 305 on body 301. Shaped flange 342 is preferably shaped to fit snugly into shaped recess 311 when saver sub 341 is operatively received all the way into body 301 through screen insertion port 305. The shaping on shaped flange 342 and shaped recess 311 is selected and oriented so that when saver sub 341 is operatively received all the way into body 301, saver sub cutout 343 in saver sub 341 is oriented and positioned within saver sub chamber 313, and with respect to mud inlet chamber 312, so as to form a continuous smooth-walled passageway through mud inlet chamber 312, into saver sub 341 through cutout 343, and into screen cage 321. Preferably, shaped flange 342 and shaped recess 311 cooperate to locate saver sub cutout 343 in a predetermined unitary location and a predetermined unitary orientation relative to mud inlet chamber 312 each time saver sub 341 is inserted through screen insertion port 305. In this way, annular protrusions or obstructions in the continuous smooth-walled passageway are minimized, discouraging turbulence in the flow path. As a result, the continuous smooth-walled passageway promotes laminar flow of mud through mud inlet chamber 312, past magnetic rod 331 (where provided) and into screen cage 321. Such laminar flow is illustrated on FIG. 9. FIG. 9 is an enlargement of the inlet end of FIG. 4, with arrows F depicting laminar flow of fluid through MSM 300. Laminar flow (and associated discouragement of turbulence) will be understood to enhance flow volumes and flow rates of fluid through MSM 300. Laminar flow (and associated discouragement of turbulence) will further be understood to encourage solids and debris into screen cage 321, and to deter buildup of solids and debris in saver sub 341. Further, as noted above, with turbulence in the fluid flow path discouraged, premature wear on components in the flow path (e.g. mud inlet 312, interior of saver sub 341) may be optimized.

Field testing has demonstrated high wear performance of MSM embodiments as described in this disclosure. In one field test, an MSM embodiment according to this disclosure was placed in standard drilling fluid service for 2,200 circulating hours before replacement of the screen cage. Inspection of the interior of the saver sub revealed only 0.002" wear and no cavitation present (suggesting low turbulence in fluid flow). No prior surface hardening or wear coating had been done on the internals.

In a second field test, an MSM embodiment according to this disclosure was placed standard drilling fluid service for 2,170 circulating hours. The average working fluid pressure was 3,400 psi, the average flow rate was 600 gpm and the average fluid temperature was 175 deg F. at the rig floor. Inspection of the interior of the saver sub revealed less than 0.003" wear and no cavitation present (again, suggesting low turbulence in fluid flow). As before, no prior surface hardening or wear coating had been done on the internals.

Figure 6C:
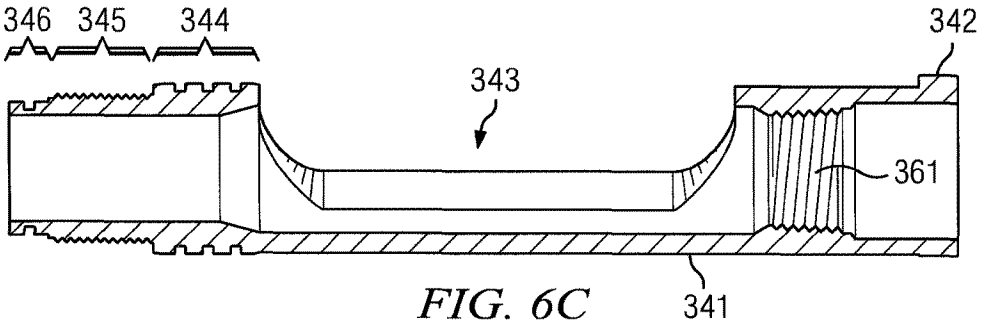
Figure 7B:
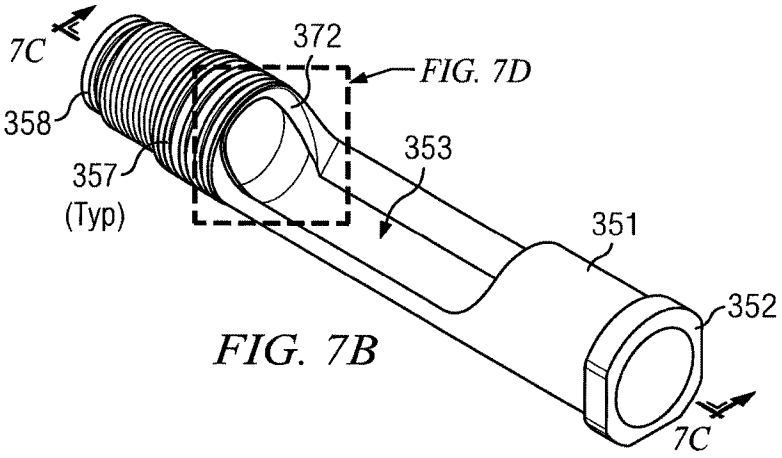
FIGS. 7A through 7D illustrate various views and features of an alternative saver sub embodiment 351.
Figure 7D:
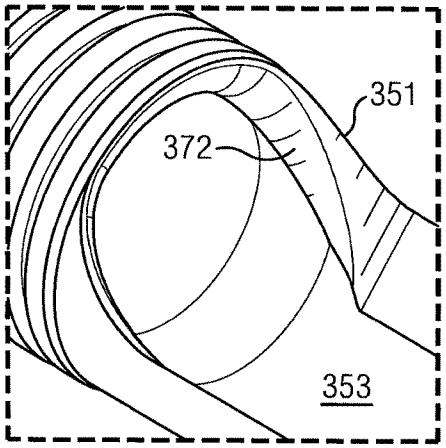
Figure 7A:
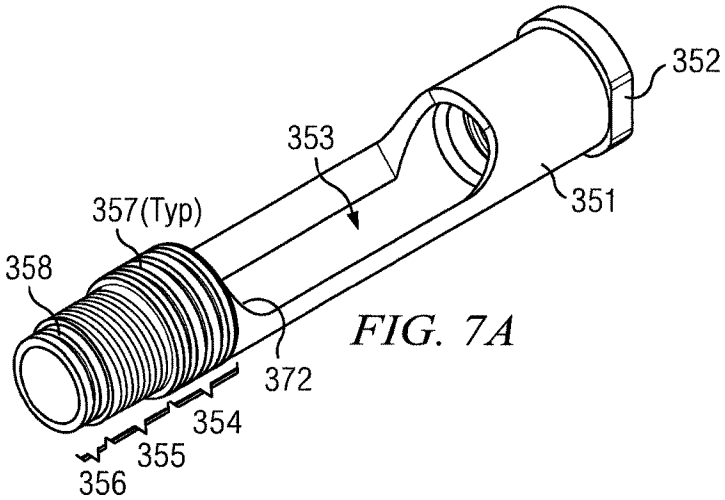
Figure 7C:
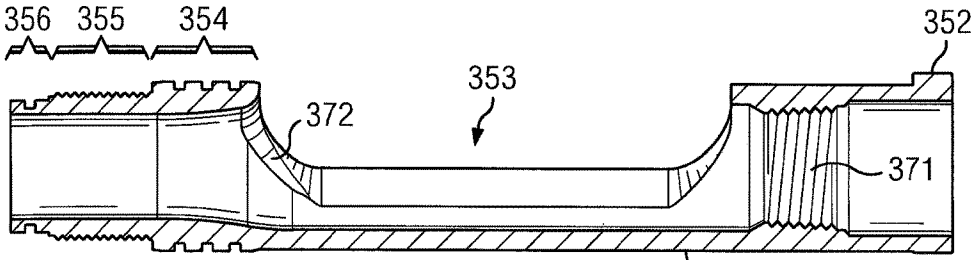

FIGS. 7A through 7D illustrate features of saver sub 351. Saver sub 351 is an alternative embodiment of saver sub 341 shown on FIGS. 6A through 6D. FIGS. 7 through 7D show saver sub 351 providing shaped flange 352 on a first end thereof, and saver sub cutout 353 between first and second ends of saver sub 351. Saver sub 351 further provides first seal portion 354, threaded portion 355, second seal portion 356, o-ring grooves 357 on first seal portion 354, and o-ring groove 358 on second seal portion 356. FIG. 7C further illustrates saver sub interior threads 371 between cutout 353 and shaped flange 352. FIG. 7D is an enlargement as shown on FIG. 7B. FIGS. 7A though 7D further illustrate that first seal portion 354, threaded portion 355 and second seal portion 356 are provided on the exterior of the second end of saver sub 351. First seal portion 354 is nearer the first end of saver sub 351 than second seal portion 356, and threaded portion 355 is positioned between first and second seal portions 354, 356. Saver sub 351 on FIGS. 7A through 7D is thus the same as saver sub 341 on FIGS. 6A through 6D except that, as shown on FIGS. 7A through 7D, saver sub 351 provides additional convex rim curvature 372 on the downstream end of saver sub cutout 353. Rim curvature 372 may be further identified by comparing FIG. 6D with FIG. 7D.

With reference now to FIG. 9, for example, it will be appreciated that if saver sub 351 on FIGS. 7A through 7D is exchanged for saver sub 341 as illustrated on FIG. 9, convex rim curvature 372 is in position to further deter turbulence and promote laminar flow as fluid flow F passes from mud inlet chamber 312 into saver sub 351 and through into screen cage 321.

In more detail, saver sub embodiments 341 and 351 thus differ further in the design of corresponding cutouts 343 and 353. As noted, saver sub 351 provides additional convex rim curvature 372 on the downstream end of saver sub cutout 353 in saver sub 351. Generally, per discussion of FIG. 9 and elsewhere above, cutouts 343, 353 are shaped and located to promote laminar flow F through inlet chamber 312 on body 301 and into saver subs 341, 351. Saver sub 341 on FIGS. 6A through 6D provides a generally elliptical yet straight-tapered cutout 343 with 4 axes of conical curvature (less rounded in its profile). Saver sub 351 on FIGS. 7A through 7D provides an elliptical opening with 5 axes of curvature (more rounded in its profile). Different machine shop capabilities (and associated manufacturing cost) may dictate preference of manufacture among these two embodiments. Generally, the 5-axis design of saver sub 351 will tend to give a smoother transition of fluid flow F through cutout 353 than the 4-axis design of saver sub 341 through cutout 343.

FIGS. 4 and 5C further illustrate fluid flow F entering assembled MSM body 301 through mud flow inlet 304 at a predetermined mud flow angle 316. In illustrated embodiments, mud inlet chamber 312 and saver sub chamber 313 are straight throughbores subtending a predetermined mud flow angle 316. In such embodiments, mud flow angle 316 is preferably selected as 45 degrees, although the scope of this disclosure is not limited in this regard. It will be appreciated from FIGS. 4 and 4A that fluid flow F changes direction by bearing on the interior metal surface of saver sub 341 before flowing into screen cage 321. In this way, mud flow wear on body 301 is reduced. Saver sub 341 is a comparatively inexpensive part to manufacture as compared to body 301. In this way, saver sub may be viewed in one aspect as sacrificial.

The selection of a preferred mud flow angle 316 of 45 degrees is as a result of trial and error, balancing competing design factors. A lower mud flow angle 316 tended to cause greater wear to screen cage 321 and thus more frequent failures of screen cage 321, due to increased velocity of fluid flow F carrying unscreened solids and debris impacting screen cage 321. Increased velocity of fluid flow F also tended to increase turbulence in the portion of saver sub 341 resident in saver sub chamber 313 on FIG. 5C. This increased turbulence detracted from the desired laminar flow per FIG. 9. A higher mud flow angle 316 tended to increase wear on the interior of saver sub 341 at the change of direction of fluid flow F. Fluid flow capacity and throughput were also impaired. Additionally, the sharper angle of direction change tended to increase turbulence and detract from the desired laminar flow per FIG. 9.

Referring now to FIGS. 4A, 5C and 6C, interior surface 309 on seal chamber 314 is preferably machined and positioned on body 301 for a precision-sealed, leak tight contact seal with saver sub first seal portion 344 when saver sub 341 is operatively received all the way into body 301 through screen insertion port 305. Currently preferred embodiments provide cooperating precision diameter machining on interior surface 309 and first seal portion 344. For example, and purely by way of illustration, interior surface 309 may have 4.007" internal diameter (+0.002", −0.000") and saver sub first seal portion 344 may have 4.004" external diameter (+0.000", −0.002"). Interior surface 309 may be machined to 32 RMS bore surface finish to assist sealing. O-rings 349 received into o-ring grooves 347 may provide additional sealing between saver sub first seal portion 344 and interior surface 309.

Similarly, now referring to FIGS. 4A, 6C and 8C, interior surface 322 on screen cage 321 is preferably machined and positioned within screen cage 321 for a precision-sealed, leak tight contact seal with saver sub second seal portion 346 when screen cage 321 is fully received onto saver sub 341 via engagement of screen cage threads 323 on saver sub threaded portion 345. Currently preferred embodiments provide cooperating precision diameter machining on interior surface 322 and second seal portion 346. For example, and purely by way of illustration, interior surface 322 may have 3.121" internal diameter (+0.002", −0.000") and saver sub second seal portion 346 may have 3.118" external diameter (+0.000", −0.002"). Interior surface 322 may be machined to 32 RMS bore surface finish to assist sealing. O-ring 349 received into o-ring groove 347 provide additional sealing between saver sub second seal portion 346 and interior surface 322.

FIGS. 4A and 6C illustrate that magnetic rod 331 attaches to the interior of saver sub 341 via threaded engagement on saver sub interior threads 361 near screen insertion port 305. FIG. 4A illustrates magnetic rod 331 providing a hexagonal recess in a head portion thereof for rotating magnetic rod 331 during such threaded engagement and disengagement with saver sub interior threads 361. Once attached to the interior of saver sub 341, magnetic rod 331 cantilevers into the open space in saver sub cutout 343. Magnetic rod 331 is thus positioned to attract and capture metal cuttings and other ferromagnetic debris in the fluid flow F during service. In addition to providing additional solids removal, magnetic rod 331 also provides some protection for the mesh screens on screen cage 321 by reducing the amount of metal cuttings required to be screened by screen cage 321. It will be understood that metal cuttings have the potential to cause premature wear to the mesh screens on screen cage 321, by potentially causing cuts and tears as fluid passes through screen cage 321.

It will be appreciated that in some embodiments (not illustrated), magnetic rod 331 may be omitted from MSM 300, particularly in deployments where metal cuttings and other ferromagnetic debris are not expected to be encountered in the fluid passing through MSM 300.

Currently preferred embodiments of MSM body 301 are manufactured from one of two material designations, "75K" and "100K", with material specifications as set forth in Table 1 below. 75K and 100K are made from ASTM/AISI 4130 steel, with the following Charpy V-notch test (CVN) requirement per ASTM 370:

Min. (−4) Deg. F 31 ft-lbs Min. (42 J) Avg.

With no single value below 21 ft-lbs (28 J)

In other embodiments, CVN may also be 15 ft-lbs (20 J) min in the transverse direction and 20 ft-lbs (27 J) min in the longitudinal direction.

TABLE 1

| Material Designation | 0.2% Yield Stress Min. (psi) | Ultimate Tensile Str. Min. (psi) | Elongation in 02" Min. (%) | Reduction in Area Min. (%) | Min. Brinell Hardness | Max. Brinell Hardness |
|---|---|---|---|---|---|---|
| 75 K | 75,000 | 95,000 | 17 | 35 | HBW 197 | HBW 237 |
| 100 K | 100,000 | 120,000 | 14 | 35 | HBW 248 | HBW 341 |

FIGS. 10A through 10J illustrate alternative embodiments of MSM body 301. FIG. 10A depicts again the embodiment of MSM body 301 illustrated on FIGS. 3 through 9, for reference and comparison purposes. FIGS. 10B through 10J illustrate alternative embodiments to MSM body 301 as shown on FIG. 10A. It will be understood that the internals on the MSM body embodiments on FIGS. 10B to 10J are the same as previously illustrated and described with reference to FIGS. 3 through 9. The MSM body embodiments on FIGS. 10B through 10J differ in exterior shape/dimension design and in manufacturing process. Table 2 below describes the differences between the alternative MSM body embodiments illustrated on FIGS. 10A through 10J.

TABLE 2

| FIG. | Part no. | Manufacturing process | Weight (gross) | Weight (without flange if present) |
|---|---|---|---|---|
| 10A | 301 | Machined and welded | 1,106 lbs | 999 lbs |
| 10B | 301B | Machined and welded | 3,263 lbs | 3,156 lbs |
| 10C | 301C | Machined only | 4,138 lbs | |
| 10D | 301D | Machined only | 2,383 lbs | |
| 10E | 301E | Sand cast | 1,189 lbs | |
| 10F | 301F | Sand cast | 1,340 lbs | |
| 10G | 301G | Sand cast | 1,382 lbs | |
| 10H | 301H | Machined or cast | 2,538 lbs | |
| 10I | 301I | Machined only | 3,141 lbs | |
| 10J | 301J | Machined and welded | 2,431 lbs | 2,324 lbs |

It will be understood from Table 2 and FIGS. 10A through 10J that competing factors contribute to optimum exterior design and manufacture of MSM body 301. For example, simplicity and low cost of manufacture may compete with material cost, material volume and overall handling weight of the component. Further, the intended application and environment of the component may influence selection of design and/or manufacturing process. The scope of this disclosure is not limited to any particular exterior design or manufacturing process for MSM body 301.

With reference now to FIGS. 8A, 8B and 8C, screen cage 321 may be according to one of many alternative embodiments. In some embodiments, screen cage 321 may be a mud screen itself, providing screen mesh for retaining solids during fluid flow through the screen, including screen mesh designed for specific ranges of solids control or for specific applications. Likewise, materials selection for screen cage 321 may be customized. In other embodiments, screen cage 321 may act as a suitable holder and retainer for a conventional drop-in mud screen similar to those examples shown on FIG. 1E in U.S. Provisional Application Ser. No. 62/560,652, incorporated herein by reference. The scope of this disclosure is not limited in any of these regards.

Referring again to FIG. 9, surface hardenings and/or wear coatings may optionally be provided in the path of fluid flow F through mud inlet chamber 312 and saver sub 341. Examples of suitable surface hardenings are quench-polish-quench treatment (QPQ—shallow heat treatment) or carborizing (deep heat treatment). Examples of wear coatings include tungsten carbide coatings, which may be applied by spray or PTFE cloth processes.

Figure 2:
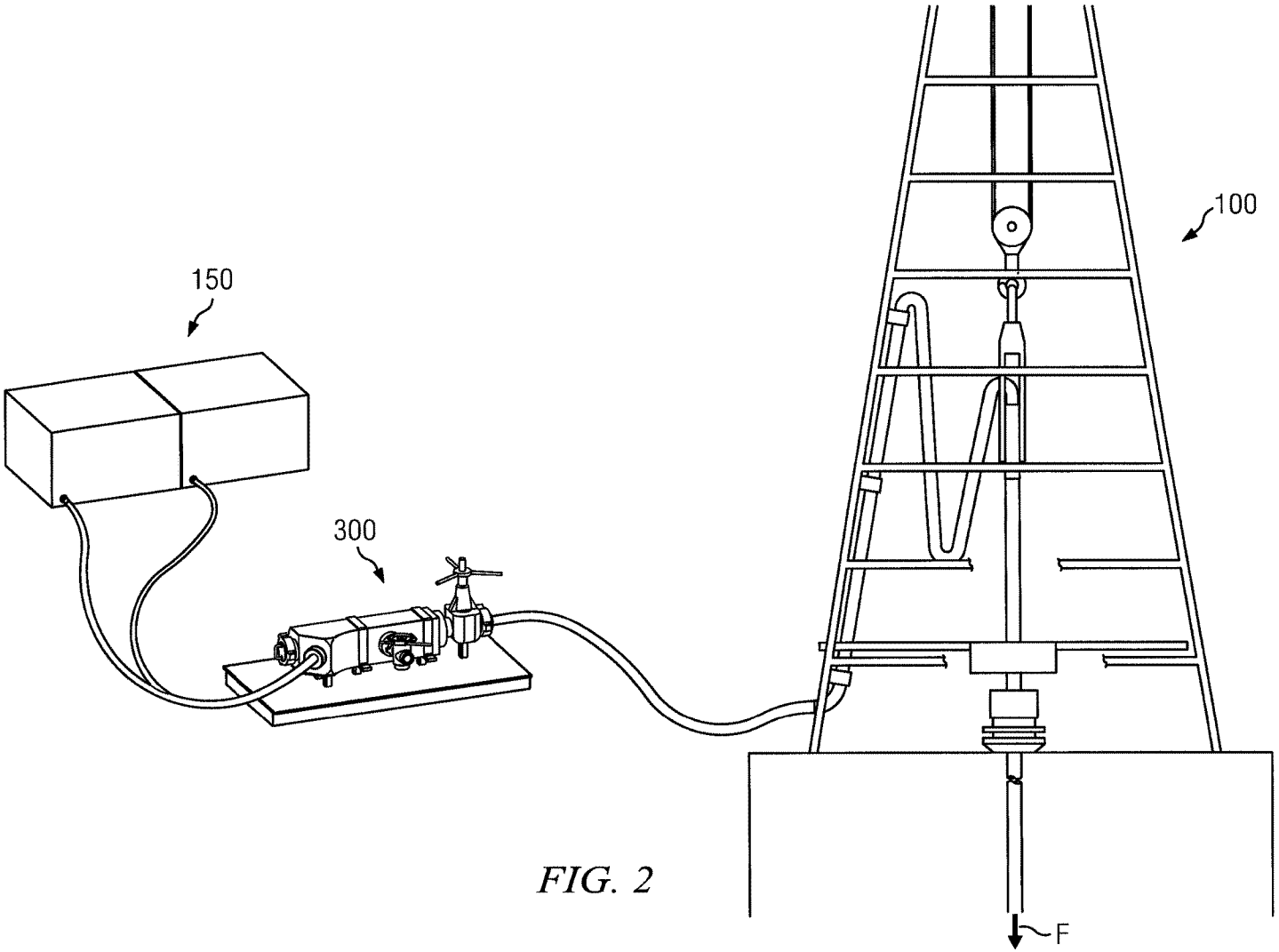
FIG. 2 illustrates schematically a currently preferred location of MSM 300 with respect to drilling mud pumps 150 and rig 100.

With further reference to FIG. 2, some embodiments provide MSM fully assembled and mounted to a skid. Skid mounting enables MSM 300 to be safely and efficiently placed into its desired position at the rig site. Extra parts, such as extra screen cages 321, saver subs 341 or magnetic rods 331 may be provided pre-mounted on the skid. Specialized insertion and extraction tools, such as tool T described above, may also be provided pre-mounted on the skid. The skid further preferably provides an environmentally friendly catch pan/trough to serve as containment for any fluids that could potentially drip out of the unit while being serviced.

Although the inventive material in this disclosure has been described in detail along with some of its technical advantages, it will be understood that various changes, substitutions and alternations may be made to the detailed embodiments without departing from the broader spirit and scope of such inventive material as defined by the appended claims. It will be further appreciated by those skilled in the art that the concepts and the specific embodiments disclosed may be readily utilized as a basis for modifying or designing other structures for carrying out the same inventive purposes of the disclosed technology, and that these equivalent constructions do not depart from the spirit and scope of the technology as described and/or as claimed.

We claim:

1. A Mud Screen Manifold (MSM), comprising:

a body, the body having mud flow inlet, a mud flow outlet and a screen insertion port;

the body further having a saver sub chamber, a seal chamber, a screen chamber and a mud inlet chamber all formed therein, the seal chamber further providing a seal chamber interior surface formed thereon;

wherein the screen insertion port is in fluid flow communication with the saver sub chamber, the mud flow outlet is in fluid flow communication with the screen chamber, and the seal chamber is in fluid flow communication with the saver sub chamber and the screen chamber;

a hollow saver sub, the saver sub further having first and second saver sub ends, the saver sub having a cutout therein between the first and second saver sub ends;

a shaped flange provided on the first saver sub end, the shaped flange disposed to be received into a correspondingly shaped recess formed in the saver sub chamber;

an exterior of the second saver sub end having a first seal portion formed therein;

wherein, when an elongate screen cage is rigidly connected to the second saver sub end, and when the saver sub and the screen cage are inserted through the screen insertion port and into the saver sub chamber such that the shaped flange is received into the shaped recess: (1) the mud flow inlet is in fluid flow communication with the saver sub cutout via the mud inlet chamber, (2) the saver sub is in fluid flow communication with the screen chamber via fluid flow through the screen cage; and (3) the saver sub first seal portion forms a first contact seal with the seal chamber interior surface.

2. The MSM of claim 1, in which:

the exterior of the second saver sub end has first and second seal portions formed therein with the first seal portion nearer the first saver sub end than the second seal portion;

the exterior of the second saver sub end further provides an exterior threaded portion between the first and second seal portions; and the screen cage has an interior cage surface such that the interior cage surface forms a second contact seal with the saver sub second seal portion when the screen cage is rigidly connected to the second saver sub end via threaded engagement with the exterior threaded portion.

3. The MSM of claim 2, in which a selected one of the first contact seal and the second contact seal further includes at least one o-ring.

4. The MSM of claim 1, further comprising a magnetic rod, the magnetic rod disposed to be rigidly connected to the saver sub while positioned within the saver sub.

5. The MSM of claim 4, in which:

the first saver sub end provides saver sub interior threads; and the magnetic rod is disposed to be rigidly connected to the saver sub via threaded engagement with the saver sub interior threads.

6. The MSM of claim 1, in which:

the shaped flange and the shaped recess cooperate to locate the saver sub cutout in a predetermined unitary location and a predetermined unitary orientation relative to the mud inlet chamber each time the shaped flange is received into the shaped recess.

7. The MSM of claim 6, in which the mud inlet chamber and the saver sub chamber are straight throughbores subtending a predetermined mud flow angle.

8. The MSM of claim 7, in which the predetermined mud flow angle is 45 degrees.

9. The MSM of claim 1, in which the mud inlet chamber and the saver sub chamber are straight throughbores subtending a predetermined mud flow angle.

10. The MSM of claim 9, in which the predetermined mud flow angle is 45 degrees.

11. The MSM of claim 1, in which the mud inlet chamber, the saver sub and the saver sub cutout cooperate to form a smooth-walled passageway for fluid flow communication between at least the mud inlet chamber and the screen cage.

12. The MSM of claim 11, in which the mud inlet chamber and the saver sub chamber are straight throughbores subtending a predetermined mud flow angle.

13. The MSM of claim 12, in which the predetermined mud flow angle is 45 degrees.

14. The MSM of claim 1, in which a downstream end of the saver sub cutout provides convex rim curvature.

15. The MSM of claim 1, in which the screen cage includes screen mesh for retaining solids during said fluid flow through the screen cage.

16. The MSM of claim 1, in which the screen cage acts as a retainer for a separate drop-in mud screen.

17. A Mud Screen Manifold (MSM), comprising:

a body, the body having mud flow inlet, a mud flow outlet and a screen insertion port;

the body further having a saver sub chamber, a seal chamber, a screen chamber and a mud inlet chamber all formed therein, the seal chamber further providing a seal chamber interior surface formed thereon;

wherein the screen insertion port is in fluid flow communication with the saver sub chamber, the mud flow outlet is in fluid flow communication with the screen chamber, and the seal chamber is in fluid flow communication with the saver sub chamber and the screen chamber;

a hollow saver sub, the saver sub further having first and second saver sub ends, the saver sub having a cutout therein between the first and second saver sub ends;

a shaped flange provided on the first saver sub end, the shaped flange disposed to be received into a correspondingly shaped recess formed in the saver sub chamber;

an exterior of the second saver sub end having first and second seal portions formed therein with the first seal portion nearer the first saver sub end than the second seal portion;

an elongate screen cage, the screen cage having an interior cage surface such that the interior cage surface forms a first contact seal with the saver sub second seal portion when the screen cage is rigidly connected to the second saver sub end;

wherein, when the screen cage is rigidly connected to the second saver sub end, and when the saver sub and the screen cage are inserted through the screen insertion port and into the saver sub chamber such that the shaped flange is received into the shaped recess: (1) the mud flow inlet is in fluid flow communication with the saver sub cutout via the mud inlet chamber; (2) the saver sub is in fluid flow communication with the screen chamber via fluid flow through the screen cage; and (3) the saver sub first seal portion forms a second contact seal with the seal chamber interior surface.

18. A Mud Screen Manifold (MSM), comprising:

a body, the body having mud flow inlet, a mud flow outlet and a screen insertion port;

the body further providing a saver sub chamber, a screen chamber and a mud inlet chamber all formed therein and all in fluid flow communication with each other;

wherein the screen insertion port is in fluid flow communication with the saver sub chamber, and the mud flow outlet is in fluid flow communication with the screen chamber;

a hollow saver sub, the saver sub further having first and second saver sub ends, the saver sub having a cutout therein between the first and second saver sub ends;

wherein, when an elongate screen cage is rigidly connected to the second saver sub end, and when the saver sub and the screen cage are inserted through the screen insertion port and into the saver sub chamber such that the first saver sub end is towards the screen insertion port: (1) the mud flow inlet is in fluid flow communication with the saver sub cutout via the mud inlet chamber; (2) the saver sub is in fluid flow communication with the screen chamber via fluid flow through the screen cage; and (3) the mud inlet chamber, the saver sub and the saver sub cutout cooperate to form a smooth-walled passageway for fluid flow communication between at least the mud inlet chamber and the screen cage.

19. The MSM of claim 18, in which:

a shaped flange is provided on the first saver sub end, the shaped flange disposed to be received into a correspondingly shaped recess formed in the saver sub chamber;

wherein the shaped flange and the shaped recess cooperate to locate the saver sub cutout in a predetermined unitary location and a predetermined unitary orientation relative to the mud inlet chamber each time the saver sub is inserted through the screen insertion port such that the shaped flange is received into the shaped recess.

20. The MSM of claim 18, in which the mud inlet chamber and the saver sub chamber are straight through-bores subtending a predetermined mud flow angle.

* * * * *